US005583475A

United States Patent [19]

Raholijaona et al.

[11] Patent Number: 5,583,475

[45] Date of Patent: Dec. 10, 1996

[54] METHOD OF MANUFACTURING A COIL ON A TOROIDAL MAGNETIC CIRCUIT

[75] Inventors: Rouelle Raholijaona, Villemandeur; Luc Colombel, Mennecy; Roger Deon, Torvilliers, all of France

[73] Assignee: Mecagis, Montarais, France

[21] Appl. No.: 382,417

[22] Filed: Feb. 2, 1995

[30] Foreign Application Priority Data

Feb. 16, 1994 [FR] France ..... 94 01772

[51] Int. Cl.[6] ..... H01F 5/00

[52] U.S. Cl. ..... 336/229; 336/212; 29/605; 29/602.1

[58] Field of Search ..... 336/229, 212; 29/605

[56] References Cited

U.S. PATENT DOCUMENTS

| | | | |
|---|---|---|---|
| 1,656,933 | 1/1928 | Ahlstrand | 29/605 |
| 1,994,534 | 3/1935 | Robinson | 175/359 |
| 3,153,841 | 10/1964 | Schrot | 29/155.57 |
| 4,782,582 | 11/1988 | Venezia | 29/605 |
| 5,247,907 | 1/1994 | Moorehead | 29/736 |
| 5,331,729 | 7/1994 | Moorehead | 29/605 |

FOREIGN PATENT DOCUMENTS

| | | | |
|---|---|---|---|
| 566303 | 10/1993 | European Pat. Off. | H01J 9/236 |
| 874559 | 7/1987 | WIPO . | |

OTHER PUBLICATIONS

Patent Abstracts of Japan, vol. 6 No. 215, (E–138) (1093) Oct. 28, 1982 & JP–A–57120314.

*Primary Examiner*—Brian W. Brown
*Assistant Examiner*—G. R. Lord
*Attorney, Agent, or Firm*—Cushman, Darby & Cushman; IP Group of Pillsbury; Madison & Sutro LLP

[57] ABSTRACT

The method comprises producting a linear coil (4) by winding around a cylindrical mandrel (5) a conductor wire coated with a thermo-adhesive varnish, opening the toroidal magnetic circuit (1), withdrawing the linear coil (4) from the cylindrical mandrel (5), heating the linear coil (4) so as to render it flexible, slapping the linear coil over the open toroidal magnetic circuit (1), reclosing the toroidal magnetic circuit, and allowing the assembly to cool.

9 Claims, 1 Drawing Sheet

METHOD OF MANUFACTURING A COIL ON A TOROIDAL MAGNETIC CIRCUIT

BACKGROUND OF THE INVENTION

The present invention relates to the manufacture of a coil on a toroidal magnetic circuit provided with an air gap.

Many electric apparatuses comprise a coil surrounding a toroidal magnetic circuit having an air gap. They are in particular zero-flux Hall-effect current sensors, self-inductors, transformers with an air gap.

To produce these coils, there is employed a shuttle or spool previously loaded with conductor wire which is passed around the magnetic circuit so as to lay, upon each revolution, a turn of wire on the magnetic circuit.

This method has several drawbacks. In particular, the conductor wire undergoes considerable tensions which requires the use of a conductor wire provided with a relatively thick insulating coating so that, for a given number of turns, there is an increase in the overall size of the coil which results in a limitation in the maximum possible number of turns for a magnetic circuit of given size. Further, with this known method, the precise control of the number of turns, of the distribution of the turns and of the length of wire employed is difficult, which limits the precision obtainable for the electrical characteristics of the apparatus thus obtained. In particular, with this method, it is impossible to produce a coil having a constant outside diameter. It is necessary to produce more turns in the central part than at the ends of the coil. Consequently, for a given number of turns, the maximum diameter of the coil is much larger than the outside diameter of an equivalent cylindrical coil. Lastly, this method is relatively costly.

SUMMARY OF THE INVENTION

An object of the present invention is to overcome these drawbacks by providing a method of manufacturing coils on a toroidal magnetic circuit including an air gap, which are more compact, more precise and cheaper than the coils obtained in the prior art.

The invention therefore provides a method of manufacturing a coil on a magnetic circuit including an air gap, characterized in that it comprises producing a linear coil by winding around a cylindrical mandrel a conductor wire coated with a thermo-adhesive varnish, opening the toroidal magnetic circuit by separating the lips of the air gap, withdrawing the linear coil from the cylindrical mandrel, slipping the linear coil over the toroidal magnetic circuit, closing the toroidal magnetic circuit and allowing the assembly to cool.

According to other features, the invention comprises:

separating the lips of the air gap in a direction perpendicular to the plane of the toroidal magnetic circuit;

heating the toroidal magnetic circuit so as to bring it to a temperature around the heating temperature of the linear coil.

The thermo-adhesive varnish is for example polyurethane modified with polyester and covered with a polyamine coating (according to the standards NFC 31.622 and CEI 55-1 and CEI 55-2) and the temperature of the heating of the linear coil is between about 140° and 160° C. for a class F wire (standard NFC 31,461).

In the described embodiment, the linear coil may be produced with a grade 1, class F copper wire 0.18 mm to 0.25 mm in diameter. For example, the toroidal magnetic circuit is formed of a soft iron-nickel alloy containing about 80% nickel.

BRIEF DESCRIPTION OF THE DRAWINGS

The invention will now be described in more detail with reference to the accompanying Figures in which.

DETAILED DESCRIPTION OF THE PRESENTLY PREFERRED EXEMPLARY EMBODIMENT

Figure 1:
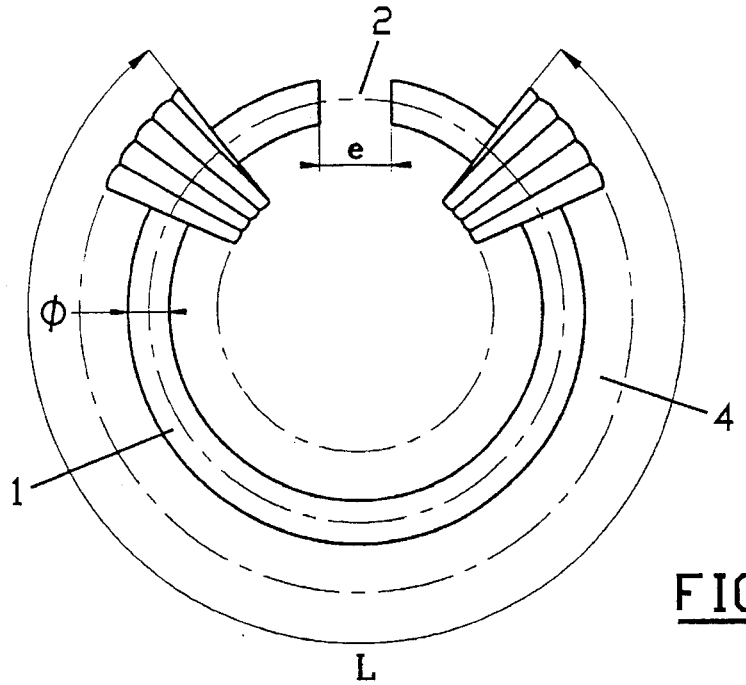
FIG. 1 shows diagrammatically a toroidal magnetic core with an air gap provided with a coil.
Figure 2:
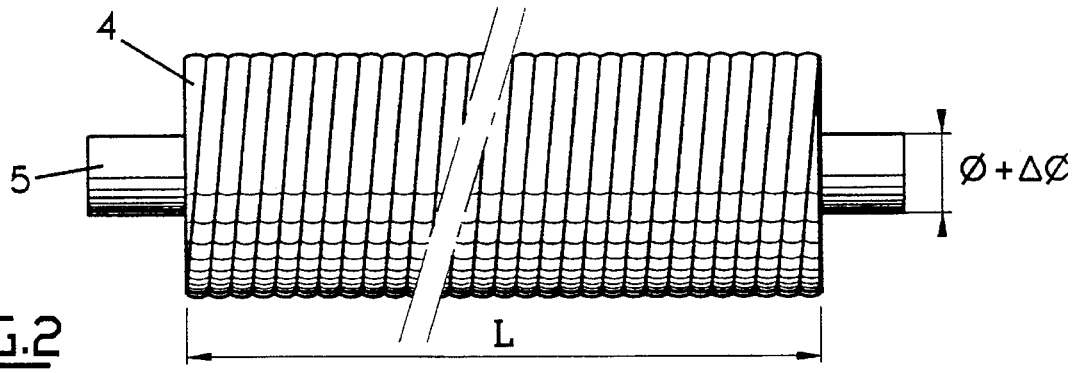
FIG. 2 shows a cylindrical coil on a rectilinear mandrel.
Figure 3:
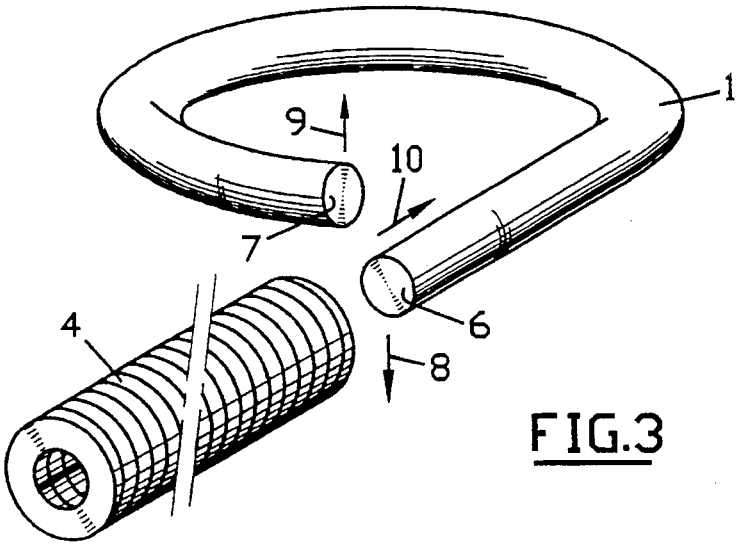
FIG. 3 shows diagrammatically the placing of a coil on a toroidal magnetic core with an air gap.

To produce an electrical circuit of a coil around a toroidal magnetic core with an air gap, employed in particular for the manufacture of zero-flux Hall-effect current sensors, such as those disclosed in French patent application No. 93 03 612, there is employed a method comprising taking a toroidal magnetic core 1 with an air gap, constituted by a rod of diameter $\phi$ of soft iron-nickel alloy containing about 80% nickel. The toroidal magnetic core 1 with an air gap is a circular ring cut at one point, the cut constituting an air gap 2 of width e. Disposed around the toroidal magnetic core 1 with an air gap is a coil 4 formed by wound electrically conductive wires. The conductive wires are copper wires coated with a thermo-adhesive insulating varnish conforming to the standards NFC 31.622, CEI 55-1 and 55-2, the varnish is a polyurethane modified with polyester and covered with a coating of polyamine. The coil has a developed length L less than the developed length of the toroidal magnetic core and an inside diameter $\phi+\Delta\phi$ slightly larger than the diameter o of the rod constituting the toroidal core.

To manufacture the coil, a cylindrical coil 4 is produced in the known manner by winding the conductor wire around a cylindrical mandrel 5 of diameter $\phi+\Delta\phi$ by distributing the turns in accordance with the envisaged application, and the turns are made to adhere to one another by heating at between 140° and 160° C.

This heating also produces a polymerization of the assembly. There is obtained in this way a mechanically homogeneous and rigid block whose geometrical and electric characteristics are well controlled.

When the cylindrical coil 4 is terminated, it is possible to check it with precision in the known manner.

The coil 4 is then slipped onto the core 1. To this end, the ends of the lips 6 and 7 are spread apart in a direction perpendicular to the plane of the core (arrows 8 and 9), the coil 4 and/or the core 1 are heated either by the Joule effect by any source of heat so as to soften the varnish and create a certain flexibility, and the coil 4 is slipped over the core 1 in the direction of arrow 10. The lips 6 and 7 of the air gap of the core 1 are then put back into a position in which they are facing each other and the assembly is allowed to cool.

The fact of producing a cylindrical coil permits checking with very high precision the number of turns, the length of the wire, and the distribution of the number of turns per unit length, which permits obtaining with very good precision a coil having given electrical characteristics.

This method merely presupposes that the deformation of the core to permit the mounting of the coil does not modify the magnetic properties of the core. This is the case of cores of the magnetic Fe Ni alloy and in particular that taken as an example.

This method presents the advantage of permitting the manufacture of coils which, for identical electrical properties, are of substantially smaller volume than coils obtained in the prior art. This is due to the fact that, in the prior art, the winding of the conductor wire around a torus produces a considerable tension of the wire which requires a very thick coating of protective varnish (grade 2 wires), whereas the method according to the invention is carried out without torsion of the wire, so that wires having a very much thinner coating of varnish may be used (grade 1 wires).

A grade n wire is protected by n coats of varnish.

Further, with the method of the prior art it is impossible to produce a toroidal coil of constant diameter with a wire diameter of less than 0.4 mm.

As an example, there was produced, for a constant volume, a coil of 2,500 turns with a wire whose copper diameter was 0.25 mm, whereas with the prior art it was necessary to employ a wire whose copper diameter was 0.225 mm. A diminished electric resistance resulted.

In a general way, with the method according to the invention, there were produced with wires of a diameter of less than 0.5 mm toroidal coils having perfectly arranged contacting turns and end faces perpendicular to the mean line of the coil.

In contrast with the prior art, it was possible to achieve a better control of the various geometrical and therefore electrical parameters of the coil (resistance, capacity between the turns) and a better positioning of the coil with respect to the air gap of the core (±0.1 mm instead of ±3 mm).

Lastly, by welding the lips of the air gap by welding without filler metal, for example by a TIG welding or laser welding, very precise toroidal coils can be produced on cores without an air gap.

What is claimed is:

1. Method of manufacturing a coil on a toroidal magnetic circuit, said method comprising the following steps: producing a linear coil by winding around a cylindrical mandrel a conductor wire coated with a thermo-adhesive varnish, heating at between 140° and 160° C., said magnetic circuit including an air gap, separating lips of said air gap in a direction perpendicular to the plane of said toroidal magnetic circuit so as to open said toroidal magnetic circuit, withdrawing said linear coil from said cylindrical mandrel, heating said linear coil so as to render it flexible, slipping said linear coil over said open toroidal magnetic circuit thereby producing an assembly, reclosing said toroidal magnetic circuit, and allowing said assembly to cool.

2. Method according to claim 1, comprising heating said toroidal magnetic circuit so as to bring it to a temperature of around the temperature for heating said linear coil.

3. Method according to claim 1, wherein said thermo-adhesive varnish is a polyurethane modified with polyester and a coating of polyamine.

4. Method according to claim 3, wherein the temperature for heating said linear coil is between 140° and 160° C. for a class F wire.

5. Method according to claim 1, comprising producing said coil with a grade 1, class F copper wire 0.18 to 0.25 mm in diameter.

6. Method according to claim 1, wherein said magnetic circuit is made from an iron-nickel alloy.

7. Method according to claim 1, wherein said reclosing of said toroidal magnetic circuit is such as to leave an air gap so as to obtain a coil on a toroidal magnetic circuit including an air gap.

8. Method according to claim 1, wherein said reclosing of said toroidal magnetic circuit comprises welding said lips of said air gap together so as to obtain a coil on a toroidal magnetic circuit without an air gap.

9. An assembly comprising a coil on a toroidal magnetic core having contacting turns resulting from a method of manufacturing comprising the following steps: producing a linear coil by winding around a cylindrical mandrel a conductor wire coated with a thermo-adhesive varnish, heating between 140° and 160° C., said toroidal magnetic core including an air gap, separating lips of said air gap in a direction perpendicular to the plane of the toroidal magnetic core so as to open said toroidal magnetic core, withdrawing said linear coil from said cylindrical mandrel, heating said linear coil so as to render it flexible, slipping said linear coil over said open toroidal magnetic core, reclosing said toroidal magnetic core, and allowing the assembly to cool.

* * * * *